US008037709B2

(12) United States Patent
Strunk et al.

(10) Patent No.: US 8,037,709 B2
(45) Date of Patent: Oct. 18, 2011

(54) HEAT PUMP WITH PRESSURE REDUCER

(76) Inventors: Garrett Strunk, Tallahassee, FL (US); Edward Strunk, Tallahassee, FL (US); Garrett Strunk, Jr., Tallahassee, FL (US)

( * ) Notice: Subject to any disclaimer, the term of this patent is extended or adjusted under 35 U.S.C. 154(b) by 473 days.

(21) Appl. No.: 12/288,124

(22) Filed: Oct. 16, 2008

(65) Prior Publication Data

US 2010/0095701 A1 Apr. 22, 2010

(51) Int. Cl.
*F25B 13/00* (2006.01)

(52) U.S. Cl. ..... 62/324.1

(58) Field of Classification Search ..... 62/324.6, 62/515, 222, 56; 165/164
See application file for complete search history.

(56) References Cited

U.S. PATENT DOCUMENTS 4,123,914 A 11/1978 Perez et al.
4,311,498 A 1/1982 Miller
4,423,602 A 1/1984 Venable
4,959,975 A 10/1990 Harris
4,977,751 A * 12/1990 Hanson ..... 62/81
5,189,883 A 3/1993 Bradford
5,335,508 A 8/1994 Tippmann
5,826,433 A 10/1998 Dube
6,216,481 B1 4/2001 Kantchev
6,351,950 B1 3/2002 Duncan
6,502,412 B1 1/2003 Dube

* cited by examiner

*Primary Examiner* — Melvin Jones
(74) *Attorney, Agent, or Firm* — J. Wiley Horton

(57) ABSTRACT

A heat pump HVAC system with an integrated pressure reducer which reduces the head pressure of the system when operating in the cooling mode and thus reduces compressor workload. The heat pump HVAC system includes a compressor for compressing a refrigerant, an exterior coil positioned outside of a building, an interior coil positioned within the building, and a reversing valve for changing the flow direction of refrigerant in the refrigerant circuit. A heat exchanger is provided between the outlet of the exterior coil and the thermal expansion valve. The heat exchanger cools the refrigerant flowing between the outlet of the exterior coil and thermal expansion valve using refrigerant exiting the interior coil.

11 Claims, 4 Drawing Sheets

HEAT PUMP WITH PRESSURE REDUCER

BACKGROUND OF THE INVENTION

1. Field of the Invention

This invention relates generally to the field of heating, ventilating, and air conditioning systems. More particularly, the present invention comprises a heat pump with an integrated pressure reducer for reducing compressor workload in the cooling and heating cycles.

2. Description of the Related Art

Various heating, ventilating, and air conditioning (HVAC) systems are known in the prior art. Heat pumps are HVAC systems which use a circulating refrigerant as a medium to absorb and move heat from the space to be cooled to another space and subsequently dump the absorbed heat out of the system. Heat pumps typically employ a reversing valve which allows the refrigerant to be circulated in one direction for cooling applications and another direction for heating applications.

A simplified schematic view of a HVAC heat pump is illustrated in FIGS. 1 and 2. Heat pump 10 includes compressor 12 which is supplied with a liquefied refrigerant from accumulator 14. FIG. 1 shows heat pump operating in a cooling state. In the cooling state, heat is collected from the inside of a house through interior coil 20 (acting as an evaporator) and rejected to the atmosphere through exterior coil 18 (acting as a condenser). Reversing valve 16 directs a stream of hot compressed gas to exterior coil 18 where heat is transferred to an outdoor heat sink. Although not shown in this illustration, a fan is typically used to increase convective heat transfer via exterior coil 18. As heat is rejected to the heat sink (atmosphere) in exterior coil 18, the hot compressed gas turns into a hot condensed liquid. The hot condensed liquid stream passes through bypass valve 24 in the direction of interior coil 20. At the entrance of interior coil 20, the hot condensed liquid passes through thermal expansion valve 26 where the stream expands into a cooled vapor stream. The cooled vapor stream passes through interior coil 20 and collects indoor heat. A receiver or dryer is typically used to collect condensed moisture, but has been omitted in the view. The cooled vapor stream eventually passes through reversing valve 16 and back to accumulator 14.

FIG. 2 illustrates heat pump 10 operating in the heating mode. In the heating mode, reversing valve 16 directs a stream of hot compressed vapor from compressor 12 to interior coil 20 (which is acting as a condenser). Heat is released to the inside of the house when the hot compressed vapor stream passes through interior coil. A fan is customarily used to facilitate heat transfer via interior coil 20. As heat is released through interior coil 20 the compressed vapor stream turns to a liquid state. The liquefied refrigerant stream passes through bypass valve 28 in the direction of exterior coil 18. The liquefied refrigerant stream then passes through thermal expansion valve 22 where the refrigerant becomes a vapor and absorbs heat from the outside passing through exterior coil 18 (which is acting as evaporator). The vapor refrigerant is then directed back through reversing valve 16 to accumulator 14.

The heating mode performance of HVAC systems are typically evaluated in terms of coefficients of performance (COP), and cooling mode performance is evaluated in terms of energy efficiency ratio (EER) or seasonal energy efficiency ratio (SEER). EER is essentially the ratio of cooling capacity in Btu/Hr and the input power in watts (W) at a given operating point. SEER is related to EER. While EER is evaluated with respect to a specific internal and external temperature, the SEER is determined over a range of expected external temperatures (the normal temperature distribution for the geographical location of the SEER test).

The amount of input power required to operate a heat pump is principally dictated by the workload and efficiency of the compressor. In the cooling mode, the compressor must generate a sufficient pressure differential to drive a hot compressed vapor stream through a thermal expansion valve. When cooling demands are elevated, the compressor requires even more input power.

Because energy costs for driving HVAC systems are so substantial, measures which improve a systems energy efficiency ratio and/or reduce the compressors workload are needed.

BRIEF SUMMARY OF THE PRESENT INVENTION

The present invention generally comprises a heat pump HVAC system with an integrated pressure reducer which reduces the head pressure of the system when operating in the cooling mode and thus reduces compressor workload. The heat pump HVAC system includes a compressor for compressing a refrigerant, an exterior coil positioned to exchange heat with the environment outside the building, an interior coil positioned to exchange heat with the interior of the building, and a reversing valve for changing the flow direction of refrigerant in the refrigerant circuit. A heat exchanger is provided between the outlet of the exterior coil and the thermal expansion valve. The heat exchanger cools the refrigerant flowing between the outlet of the exterior coil and thermal expansion valve using refrigerant exiting the interior coil.

The heat pump HVAC system of the present invention is able to attain a higher energy efficiency ratio (EER) and seasonal energy efficiency ratio (SEER) than an identical system which does not employ the pressure reducer. These performance gains are largely realized by the reduced head pressure of the system caused by cooling the refrigerant before it passes through the thermal expansion valve. The heat pump HVAC system of the present invention is able to achieve this reduced head pressure without significantly affecting the system's ability to move heat.

REFERENCE NUMERALS IN THE DRAWINGS

| | | | |
|---|---|---|---|
| 10 | heat pump | 12 | compressor |
| 14 | accumulator | 16 | reversing valve |
| 18 | exterior coil | 20 | interior coil |
| 22 | thermal expansion valve | 24 | bypass valve |
| 26 | thermal expansion valve | 28 | bypass valve |
| 30 | heat exchanger | 32 | dryer filter |
| 40 | heat pump | 42 | first port |
| 44 | second port | 46 | third port |
| 48 | fourth port | | |

DETAILED DESCRIPTION OF THE INVENTION

Figure 1:
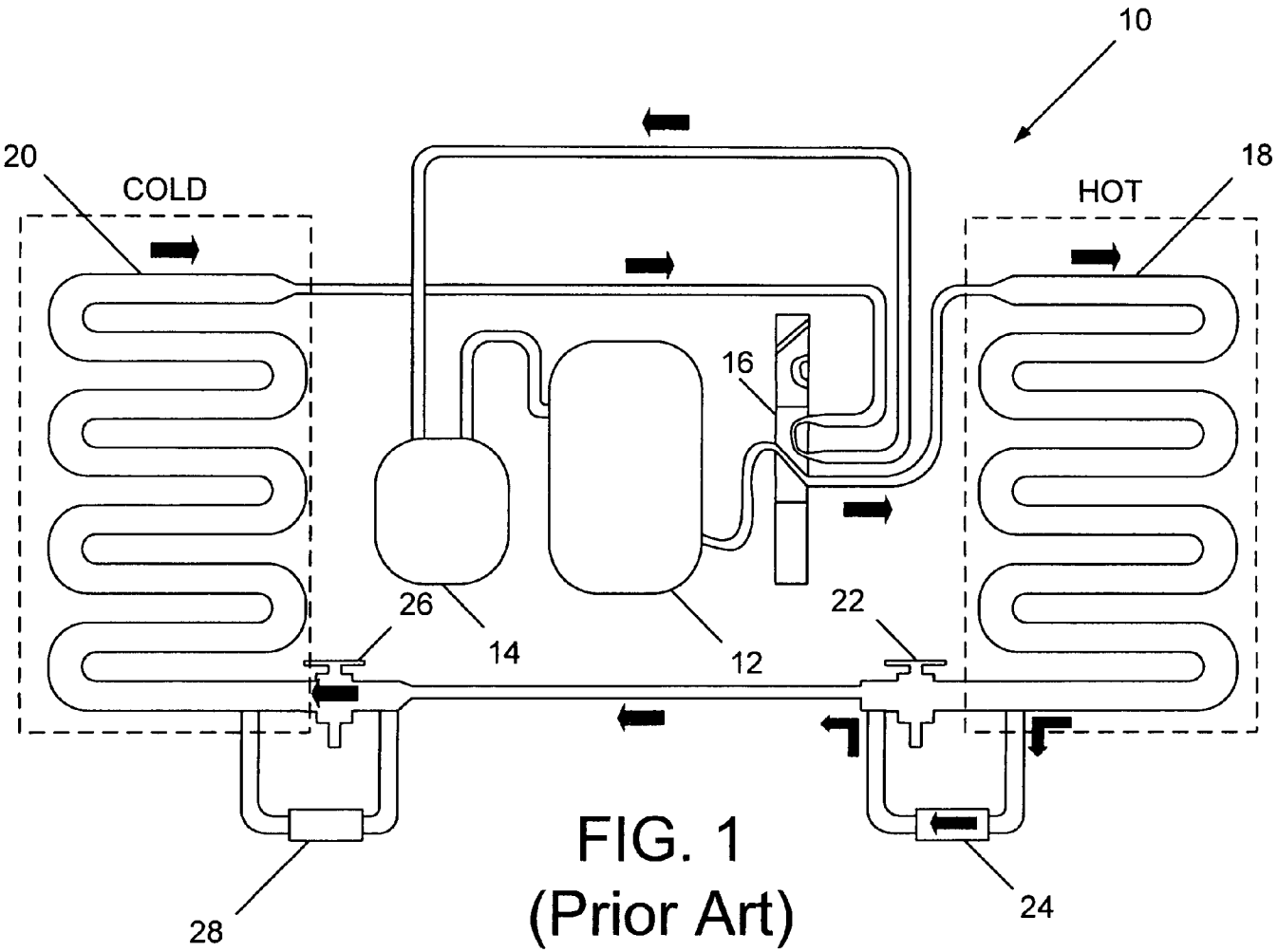
FIG. 1 (Prior Art)
FIG. 1 is a schematic, illustrating a prior art heat pump operating in cooling mode.
Figure 2:
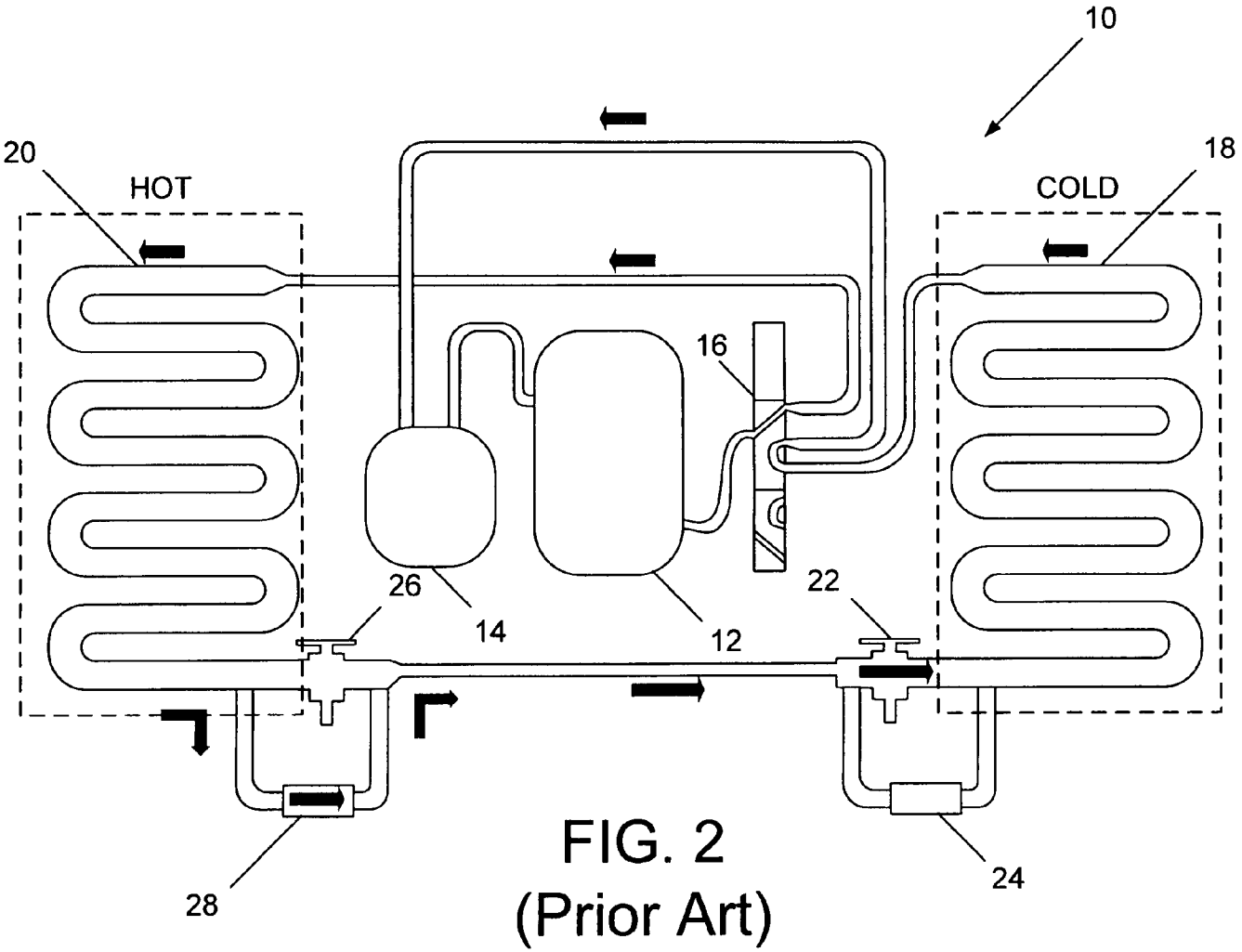
FIG. 2 (Prior Art)
FIG. 2 is a schematic, illustrating a prior art heat pump operating in heating mode.
Figure 3:
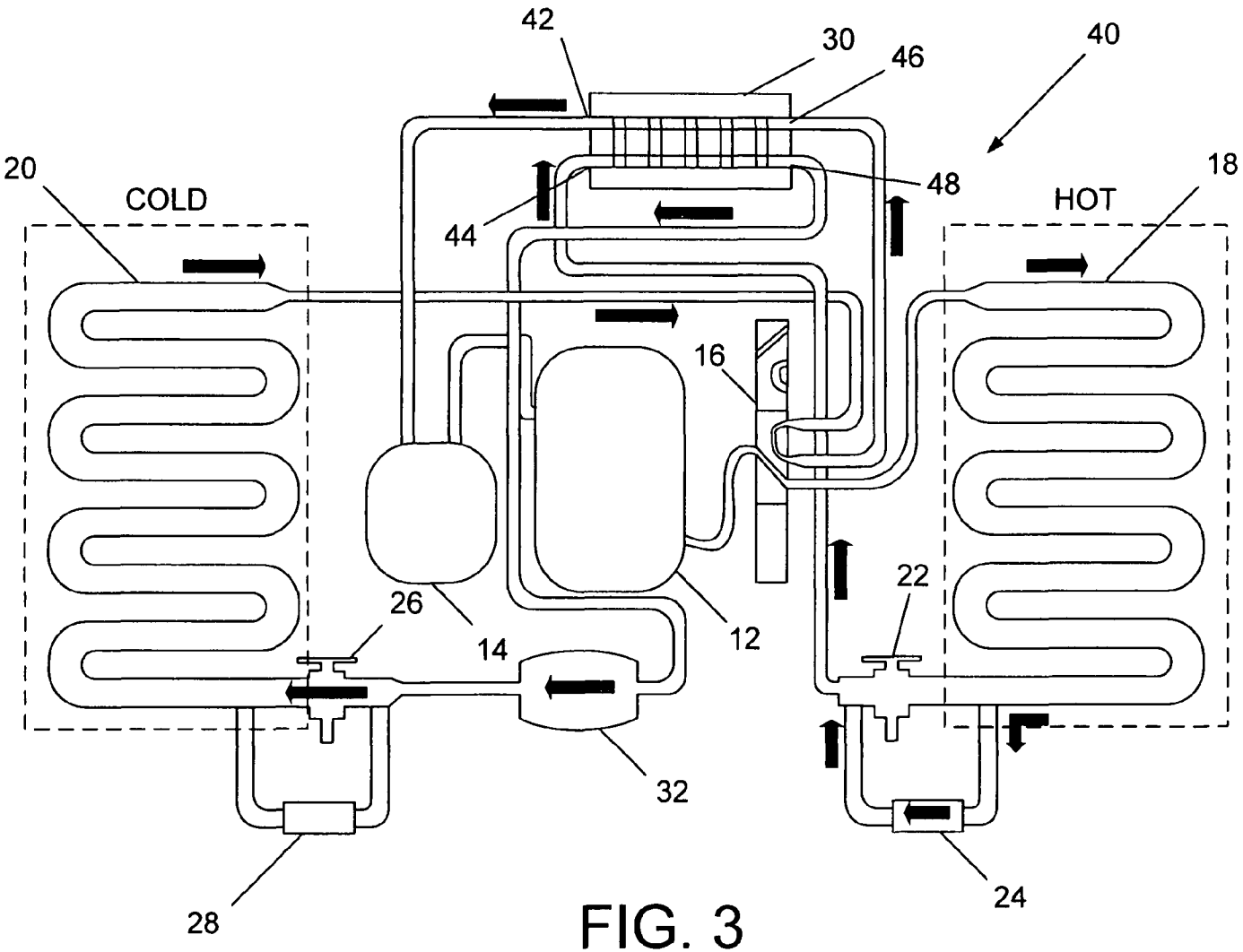
FIG. 3 is a schematic, illustrating operation of the present invention in cooling mode.
Figure 4:
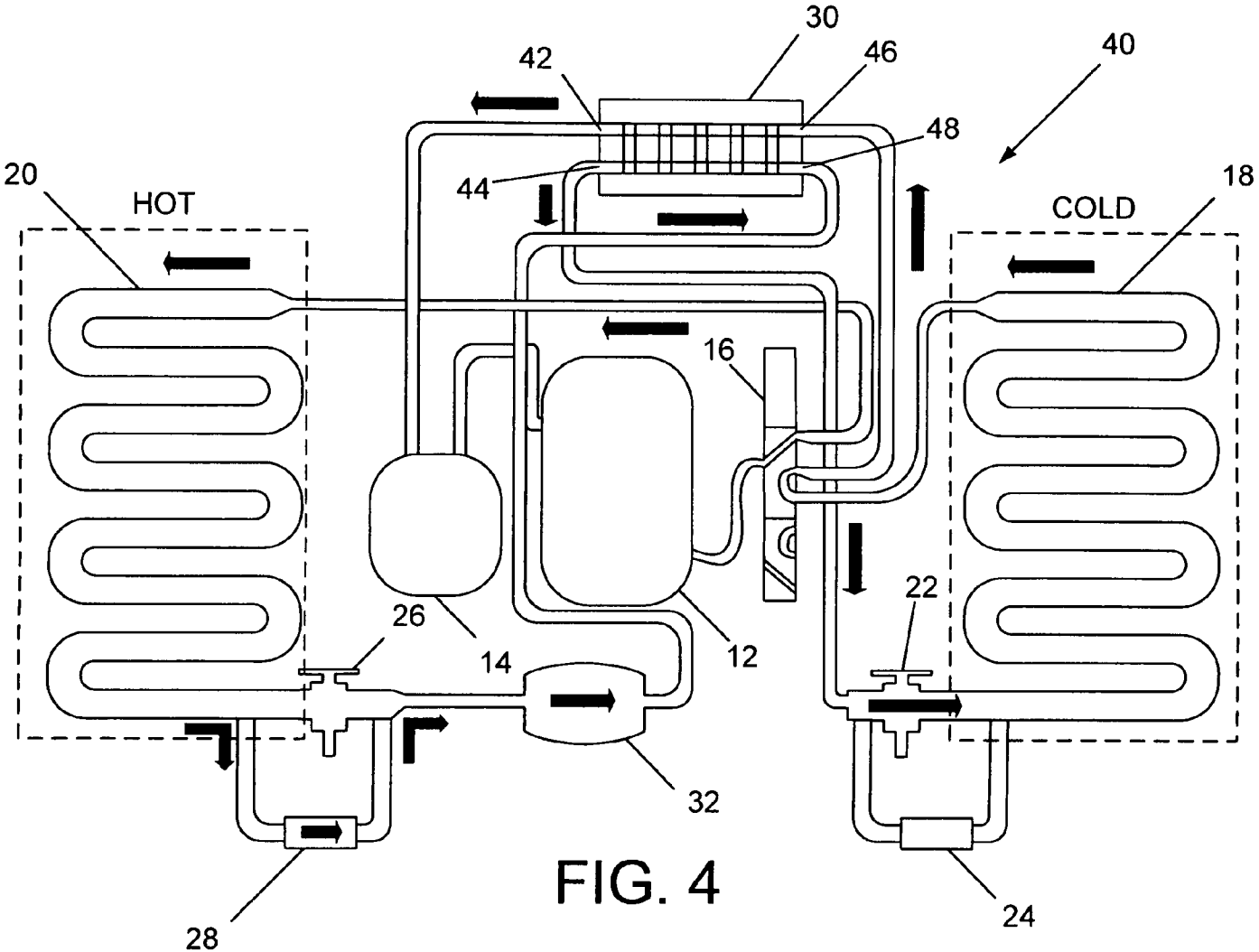
FIG. 4 is a schematic, illustrating operation of the present invention in heating mode.

The present invention, heat pump 40, is illustrated in FIGS. 3 and 4. FIG. 3 illustrates the operation of heat pump 40 in cooling mode and FIG. 4 illustrates the operation of heat pump 40 in heating mode. Reversing valve 16 may be selectively positioned in a heating position (FIG. 3) or a cooling position (FIG. 4) to control the direction a refrigerant flows through the heat pump circuit.

Turning to FIG. 3, heat pump 40 is illustrated in the cooling mode. In the cooling mode, interior coil 20 acts as an evaporator and exterior coil 18 acts as a condenser. Reversing valve 16, positioned in the cooling position, directs refrigerant flow from compressor 12 to exterior coil 18. Exterior coil 18 is positioned outside of the building cooled by heat pump 40 and transmits heat from the refrigerant flowing through exterior coil 18 to a heat sink (such as the surrounding atmosphere). As heat is transmitted via exterior coil 18, the refrigerant liquefies. In the cooling mode, bypass valve 24 is opened to direct refrigerant flow around thermal expansion valve 22.

From bypass valve 24, the refrigerant flows to heat exchanger 30. Heat exchanger 30 acts as a counter-flow heat exchanger in which cooled refrigerant exiting interior coil 20 flows over a conductive conduit which transports the hot stream of refrigerant from exterior coil 18 to thermal expansion valve 26. Heat is transferred from the hot stream to the cool stream in heat exchanger 30.

The hot stream then passes through dryer filter 32 and evaporates to a cooled gas through thermal expansion valve 26. Those that are skilled in the art know that the cooling of the gas is caused by the reduction in pressure of the gas as it passes through the expansion valve. The ideal gas law provides that the state of an amount of gas is determined by its pressure, temperature, and volume according to the equation:

$$PV=nRT$$

where P is absolute pressure, V is volume occupied by the gas, n is the amount of substance of gas (expressed in moles), R is the ideal gas constant and T is absolute temperature. In accordance with this relationship, reducing the pressure of a gas results in a corresponding reduction in temperature of the gas.

The cooled refrigerant vapor passes through interior coil 20 where heat from the interior of the building is transferred to the refrigerant passing through interior coil 20. As mentioned previously, this refrigerant passes through heat exchanger 30 where it is used to cool the hot stream of refrigerant. From heat exchanger 30 the refrigerant passes back through reversing valve 16 before collecting in accumulator 14.

Turning to FIG. 4, heat pump 40 is illustrated in the heating mode. In the heating mode, interior coil 20 acts as a condenser and exterior coil 18 acts as an evaporator.

Reversing valve 16, positioned in the heating position, directs hot compressed refrigerant vapor from compressor 12 to interior coil 20. Interior coil 18 transmits heat from the refrigerant flowing through interior coil 20 to the interior of the building. As heat is transmitted via interior coil 18, the refrigerant liquefies. In the heating mode, bypass valve 28 is opened to direct refrigerant flow around thermal expansion valve 26.

From bypass valve 28, the refrigerant flows through dryer filter 32 to heat exchanger 30. In the heating mode heat exchanger 30 acts as a parallel-flow heat exchanger in which cooled refrigerant exiting exterior coil 18 flows over a conductive conduit which transports the hot stream of refrigerant from interior coil 20 to thermal expansion valve 22. Heat is transferred from the hot stream to the cool stream in heat exchanger 30.

The hot stream then evaporates to a cooled gas through thermal expansion valve 22. The cooled refrigerant vapor passes through exterior coil 18 where heat from the outdoor air is transferred to the refrigerant passing through exterior coil 18. As mentioned previously, this refrigerant passes through heat exchanger 30 where it is used to cool the hot stream of refrigerant. From heat exchanger 30 the refrigerant passes back through reversing valve 16 before collecting in accumulator 14.

With the operation of the present invention now explained, the many advantages offered by the present invention may now be apparent to one that is skilled in the art. The reader will note that in both operating modes, heat exchanger 30 cools the "hot" stream of refrigerant before it passes through the thermal expansion valve. On a hot day, where ambient temperatures are approximately 100 degrees Fahrenheit, heat exchanger 30 may reduce the temperature of refrigerant flowing through thermal expansion valve 26 from 100 degrees Fahrenheit (in a conventional system operating without heat exchanger 30) to 40 degrees Fahrenheit (the temperature of refrigerant fourth port 48 of heat exchanger 30). This reduction in temperature (60 degrees Fahrenheit in preceding example) dramatically reduces the peak head pressure of heat pump 10 and the workload of compressor 12. The heat pump HVAC system of the present invention is able to achieve this reduced head pressure without significantly affecting the system's ability to move heat. Thus, by adding heat exchanger 30 to an existing heat pump system, a user is able to attain a higher energy efficiency ratio (EER) and seasonal energy efficiency ratio (SEER).

Such a reduction in temperature and head pressure has been observed in multiple field tests. In these field tests, a reduced compressor "amperage draw" was also observed. In many cases, the amperage draw was reduced by as much as fifty (50) percent. As such, it is estimated that the addition of such a heat exchanger in the heat pump circuit as shown in FIG. 3 and FIG. 4 can approximately double the SEER rating of a HVAC system.

In addition, the proposed configuration of the preferred embodiment allows heat exchanger 30 to act as a counter-flow heat exchanger only during cooling mode. The reader will note that whether in heating or cooling mode, refrigerant always flows from third port 46 to first port 42. In cooling mode, refrigerant flows from second port 44 to fourth port 48; however, in heating mode, refrigerant flows from fourth port 48 to second port 44. This allows the $\Delta T$ (temperature differential measured from inlet to outlet) of the hot refrigerant stream passing through heat exchanger 30 to be maximized in the cooling mode where reducing the workload of compressor 12 is most beneficial.

Those that are skilled in the art will realize that the present invention may be easily retrofitted to existing heat pump systems without requiring the addition or replacement of expensive components (such as compressor 12, interior coil 20, or exterior coil 18). Further, heat exchanger 30 may be easily plumbed to the existing refrigerant circuit in minimal time. Such a retrofit has been performed in field tests. In one field test, a heat exchanger was added (as shown in FIGS. 3 and 4) to a 2.5 ton 13 SEER heat pump HVAC system. No components of the system were changed apart from the addition of the heat exchanger and the conduits and couplings needed to plumb the heat exchanger to the system. The system originally had a compressor amperage draw of 14.6 amps before the heat exchanger was added. After the heat exchanger was added, the amperage draw was measured to be 6.5 amps with a head pressure of 125 psi. This reduction in amperage draw boosts the efficiency rating of the system from 13 SEER to more than 26 SEER.

In these retrofit field tests it was further observed that the amount of liquid refrigerant passing through accumulator 14 into compressor 12 was substantially reduced when heat exchanger 30 was added to the heat pump circuit. Those that are skilled in the art know that an electric heater is often used to preheat refrigerant before the refrigerant enters the compressor since the presence of liquid refrigerant in the compressor can damage the compressor. Such a component is not needed in the proposed heat exchanger circuit because the refrigerant is heated in heat exchanger 30 before being transmitted to accumulator 14. The removal of this electric heater would further reduce the total amperage draw of the HVAC system.

Although the preceding descriptions contain significant detail they should not be viewed as limiting the invention but rather as providing examples of the preferred embodiments of the invention. Accordingly, the scope of the invention should be determined by the following claims, rather than the examples given.

What is claimed is:

1. A heat pump for cooling and heating a building having an interior and an exterior environment by circulating a refrigerant comprising:

a. a compressor for compressing a refrigerant;

b. an interior coil exchanging heat with said interior of said building, said interior coil having an inlet and an outlet;

c. an exterior coil exchanging with said outside said interior of said building, said exterior coil having an inlet and an outlet;

d. a reversing valve fluidly connected with said compressor, said reversing valve positionable in a cooling position and a heating position, wherein when said reversing valve is positioned in said cooling position, said reversing valve directs said refrigerant from said compressor to said exterior coil, and wherein when in said reversing valve is positioned in said heating position, said reversing valve directs said refrigerant from said compressor to said interior coil;

e. a first thermal expansion valve positioned downstream of said outlet of said exterior coil and upstream of said inlet of said interior coil when said reversing valve is positioned in said cooling position; and f. a heat exchanger positioned downstream of said outlet of said exterior coil and upstream of said first thermal expansion valve when said reversing valve is positioned in said cooling position, said heat exchanger transferring heat between said refrigerant flowing between said exterior coil and said thermal expansion valve and said refrigerant flowing between said outlet of said interior coil and said compressor.

2. The heat pump of claim 1, wherein said heat exchanger acts as a counter-flow heat exchanger when said reversing valve is positioned in said cooling position.

3. The heat pump of claim 2, wherein said heat exchanger acts as a parallel-flow heat exchanger when said reversing valve is positioned in said heating position.

4. The heat pump of claim 1, wherein said heat exchanger has a first fluid circuit and a second fluid circuit, said first fluid circuit and said second fluid circuit each having an inlet and an outlet, said inlet of said first fluid circuit fluidly connected to said outlet of said interior coil and said outlet of said first fluid circuit fluidly connected to said inlet of said exterior coil, said inlet of said second fluid circuit fluidly connected to said reversing valve and said outlet of said second fluid circuit connected to said compressor.

5. The heat pump of claim 4, wherein said refrigerant flows through said second fluid circuit from said reversing valve to said compressor when said reversing valve is positioned in said cooling position and when said reversing valve is positioned in said heating position.

6. A method for reducing workload of a compressor configured to compress a refrigerant in a heat pump system having an exterior coil having an inlet and an outlet, an interior coil having an inlet and an outlet, a reversing valve positionable in a heating position and a cooling position, and a thermal expansion valve, said method comprising:

a. supplying said refrigerant through said thermal expansion valve to said inlet of said interior coil such that said refrigerant passes through said interior coil and out said outlet into a first conduit configured to transport said refrigerant back to said compressor;

b. supplying said inlet of said exterior coil with said refrigerant from said compressor such that said refrigerant passes through said exterior coil and out said outlet of said exterior coil into a second conduit configured to transport said refrigerant to said thermal expansion valve; and c. transferring heat from said refrigerant passing through said second conduit to said refrigerant passing through said first conduit before said refrigerant passing through said second conduit reaches said thermal expansion valve.

7. The method of claim 6, further comprising providing a heat exchanger positioned downstream of said outlet of said exterior coil and upstream of said thermal expansion valve when said reversing valve is positioned in said cooling position, said heat exchanger transferring heat from said refrigerant flowing between said exterior coil and said thermal expansion valve to said refrigerant flowing between said outlet of said interior coil and said compressor.

8. The heat pump of claim 7, wherein said heat exchanger acts as a counter-flow heat exchanger when said reversing valve is positioned in said cooling position.

9. The heat pump of claim 8, wherein said heat exchanger acts as a parallel-flow heat exchanger when said reversing valve is position in said heating position.

10. The heat pump of claim 7, wherein said heat exchanger has a first fluid circuit and a second fluid circuit, said first fluid circuit and said second fluid circuit each having an inlet and an outlet, said inlet of said first fluid circuit fluidly connected to said outlet of said interior coil and said outlet of said first fluid circuit fluidly connected to said inlet of said exterior coil, said inlet of said second fluid circuit fluidly connected to said reversing valve and said outlet of said second fluid circuit fluidly connected to said compressor.

11. The heat pump of claim 10, wherein said refrigerant flows through said second fluid circuit from said reversing valve to said compressor when said reversing valve is positioned in said cooling position and when said reversing valve is positioned in said heating position.

* * * * *